US005289973A

United States Patent [19]

French

[11] Patent Number: 5,289,973

[45] Date of Patent: Mar. 1, 1994

[54] SNOWMAKING METHOD AND DEVICE

[76] Inventor: Andrew B. French, 94A Reserve Road, Artarmon, Sydney, New South Wales, 2064, Australia

[21] Appl. No.: 20,264

[22] PCT Filed: Mar. 1, 1990

[86] PCT No.: PCT/AU90/00083

§ 371 Date: Nov. 8, 1990

§ 102(e) Date: Nov. 8, 1990

[87] PCT Pub. No.: WO90/10183

PCT Pub. Date: Sep. 7, 1990

Related U.S. Application Data

[63] Continuation of Ser. No. 613,774, Nov. 8, 1990, abandoned.

[30] Foreign Application Priority Data

Mar. 1, 1989 [AU] Australia ..... PJ3019
Mar. 9, 1989 [AU] Australia ..... PJ3133

[51] Int. Cl.[5] ..... A01G 15/00
[52] U.S. Cl. ..... 239/14.2; 239/2.2
[58] Field of Search ..... 239/2.2, 14.2

[56] References Cited

U.S. PATENT DOCUMENTS 3,250,530 5/1966 Dean et al. .
3,703,991 11/1972 Eustis et al. ..... 239/2.2
3,716,190 2/1973 Lindlof ..... 239/2.2
3,762,176 10/1973 Coggins, Jr. ..... 239/2.2
3,908,903 9/1975 Burns, Jr. ..... 239/2.2
3,969,908 7/1976 Lawless et al. ..... 239/2.2
4,573,636 3/1986 Dilworth et al. ..... 239/2.2
4,790,531 12/1988 Matsui et al. .
4,793,554 12/1988 Kraus et al. ..... 239/2.2
4,828,175 5/1989 Heufler et al. .

FOREIGN PATENT DOCUMENTS 277933 1/1988 European Pat. Off. .
1372024 8/1963 France .
89/00685 1/1990 PCT Int'l Appl. .

*Primary Examiner*—Andres Kashnikow
*Assistant Examiner*—Christopher G. Trainor
*Attorney, Agent, or Firm*—Amster, Rothstein & Ebenstein

[57] ABSTRACT

A device and method for the production of artificial snow. The device comprises an environment wherein temperature, humidity, and/or other environmental conditions are adapted to be controlled. The device also has at least one snow gun having at least the nozzle portion thereof provided substantially within or adjacent to the environment. Within the environment, the humidity and temperature may be controlled by a dehumidifier and a cooler or chiller, such that the environmental conditions are satisfactory for snow production. Alternatively, the controlled environment may be provided wherein the nozzle or the environment adjacent the nozzle is controlled to be of desired temperature and humidity.

10 Claims, 4 Drawing Sheets

SNOWMAKING METHOD AND DEVICE

This is a continuation of copending application Ser. No. 07/613,774 filed on Mar. 1, 1990 now abandoned.

The present invention relates to a method and apparatus for making snow, and in particular, to providing a snow-making environment wherein snow can be produced under controlled conditions.

At present, snow-making production is controlled by the natural environmental weather conditions. To produce man made snow, low temperatures and low humidity conditions are required. Unfortunately, in some parts of the world, for example, Australia, conditions are often such that the temperature and/or humidity may be low, but the other environmental factors are still unsuitable for the production of man made snow. This greatly restricts the suitable times when snow can be made.

The present invention seeks to provide a controlled environment, such that the production of snow 24 hours a day, 365 days a year, is facilitated, by providing a snow-making environment, wherein the temperature, humidity and/or other environmental factors are controlled.

In one broad form, the present invention provides a device for the production of artificial snow, said device comprising:

an environment, wherein the temperature, humidity and/or other environmental conditions are adapted to be controlled;

at least one snow gun having at least the nozzle thereof provided substantially within or adjacent to said environment.

In a further broad form, the present invention provides a method for the production of artificial snow, comprising the steps of:

providing an environment of controlled environmental conditions suitable for the production of artificial snow;

a snow gun wherein at least the nozzle thereof is provided substantially within or adjacent to said environment.

The present invention will be more fully understood from the following detailed description thereof with reference to the accompanying drawings, wherein.

Figure 1:
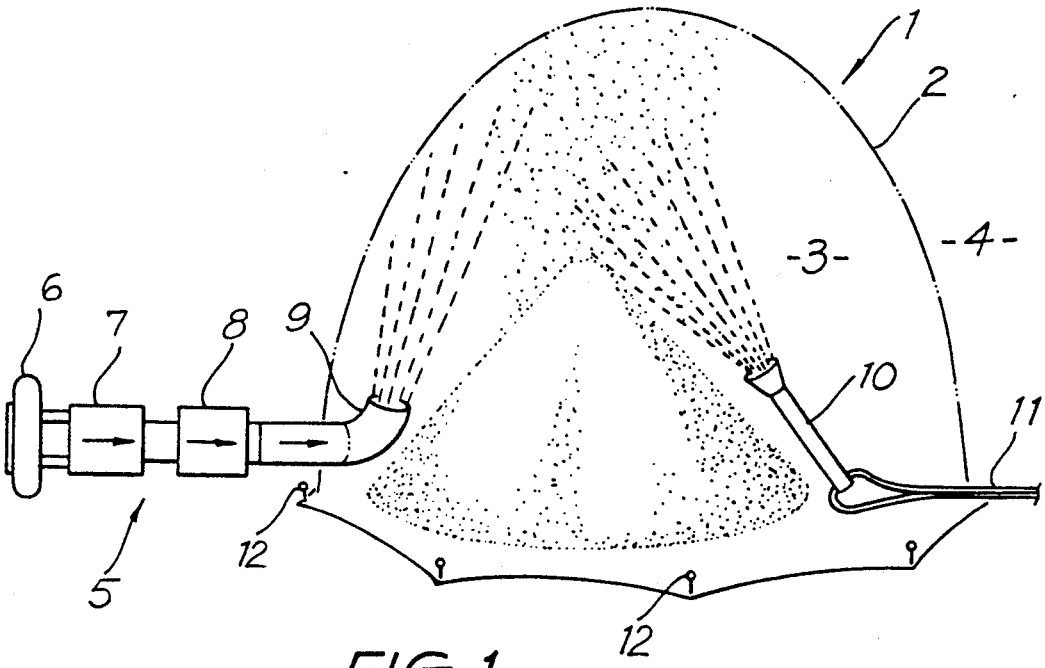
FIG. 1 shows an artificial snow making environment, together with the required machinery and snow gun associated therewith.

In FIG. 1, is illustrated an artificial snow-making environment, generally designated by the numeral 1. The artificial snow-making environment 1 comprises a tent or dome-like structure 2, which separates a closed environment system 3 from the external natural environment 4. The tent or dome-like structure 2 may be constructed in a variety of ways and utilising a variety of materials, however, obviously, the structure 2 preferably has some degree of thermal insulating characteristics, such that the energy required to achieve the desired parameters of the artificial environment 3 is minimised.

Temperature, humidity and otherwise conditioned air is supplied into the controlled environment 3 by means of appropriate machinery, generally designated by the numeral 5. In particular, the machinery consists of a fan or air pump 6 which facilitates the recycling or intake of air from the external environment 4. The air is passed through a chiller 7 and dehumidifier 8 and is exhaled into the controlled environment 3 via a nozzle 9. The water and air pipes 11 also preferably passed through a chiller. The nozzle 9 is preferably able to be swivelled such that the chilled and dehumidified air may be supplied into the controlled environment 3 at any desired direction. It should be obvious to persons skilled in the art that both temperature and humidity are preferably as low as possible, however in an environment which is above 0° C. at high humidity, it is still possible to produce snow. The optimum conditions would be at temperatures approaching −273° C. and at humidity approaching zero levels.

A snow gun 10 is also supplied within the closed controlled environment 3. The snow gun 10 is of any conventional type, requiring air and water hoses.-,Il for the production of snow.

In use, the snow-making apparatus is assembled as follows. The apparatus, which is preferably on a ski like structure, for easy transportation, is dragged to the required position by means of a skidoo or the like. The tent or dome-like structure 2 is then dragged over the snow gun 10 and the nozzle of the chilling and dehumidifying machinery 5-. The tent or dome-like structure 2 is preferably connected to the ground surface by a plurality of tent pegs or weights around the perimeter thereof. The tent or dome-like structure 2 may be be simply inflated by supplying air through the nozzle 9 of the machinery 5. Once the required parameters are achieved within the closed environment 3, the snow-making operation may be commenced.

Figure 2:
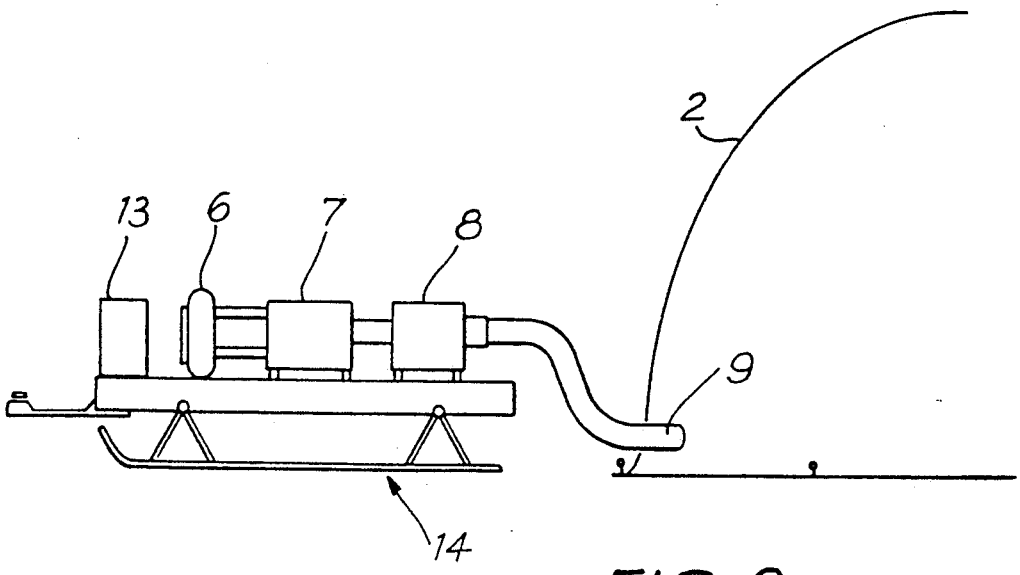
FIG. 2 illustrates the preferred portability of the snow-making apparatus in accordance with the present invention.
Figure 3A:
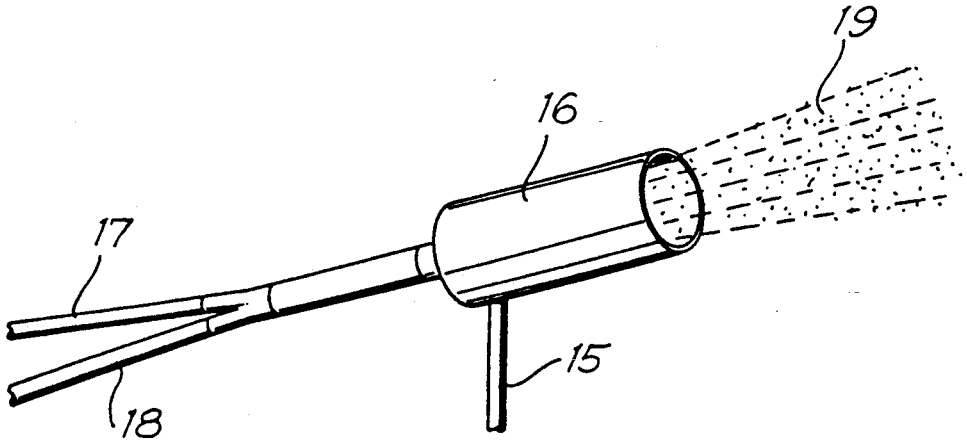
FIG. 3 illustrates three suitable nozzle arrangements in accordance with an alternative preferred embodiment of the present invention; and, FIG. 4 shows a silo-like arrangement in accordance with another embodiment of the present invention.
Figure 3B:
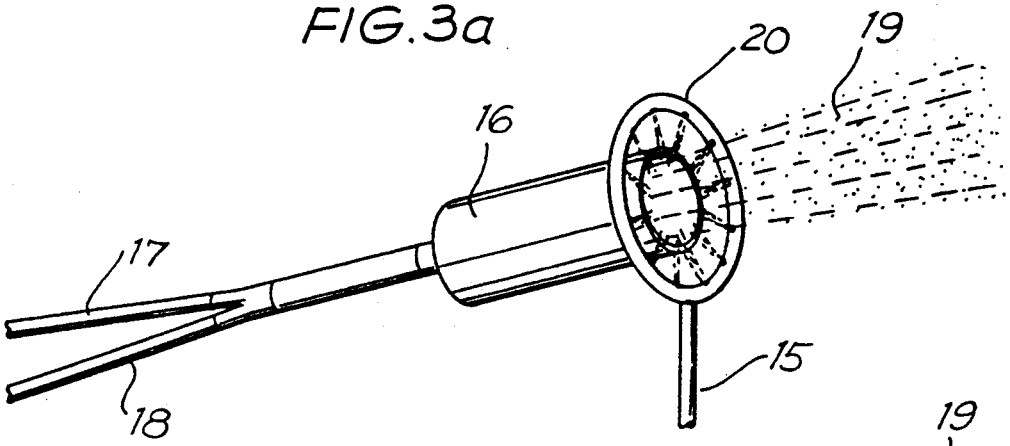
Figure 3C:
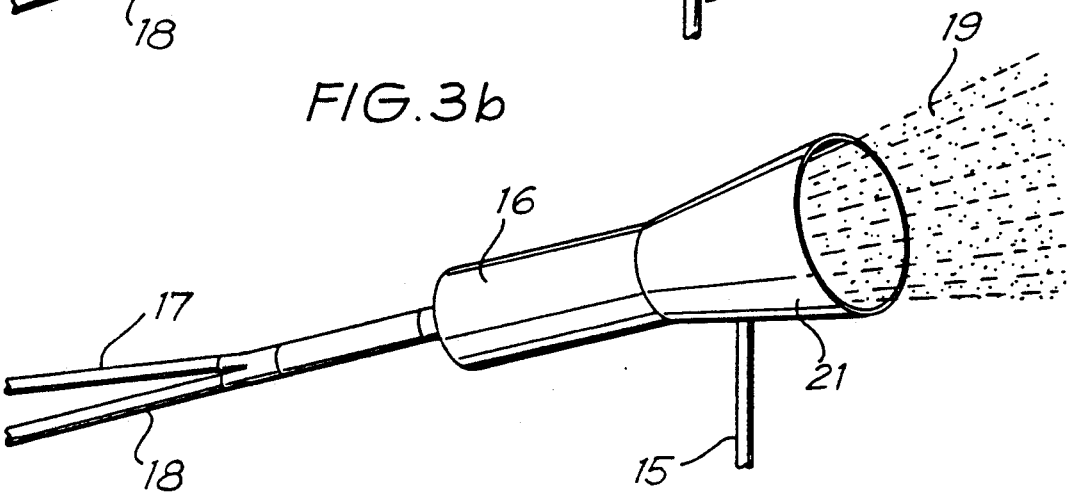
Figure 3D:
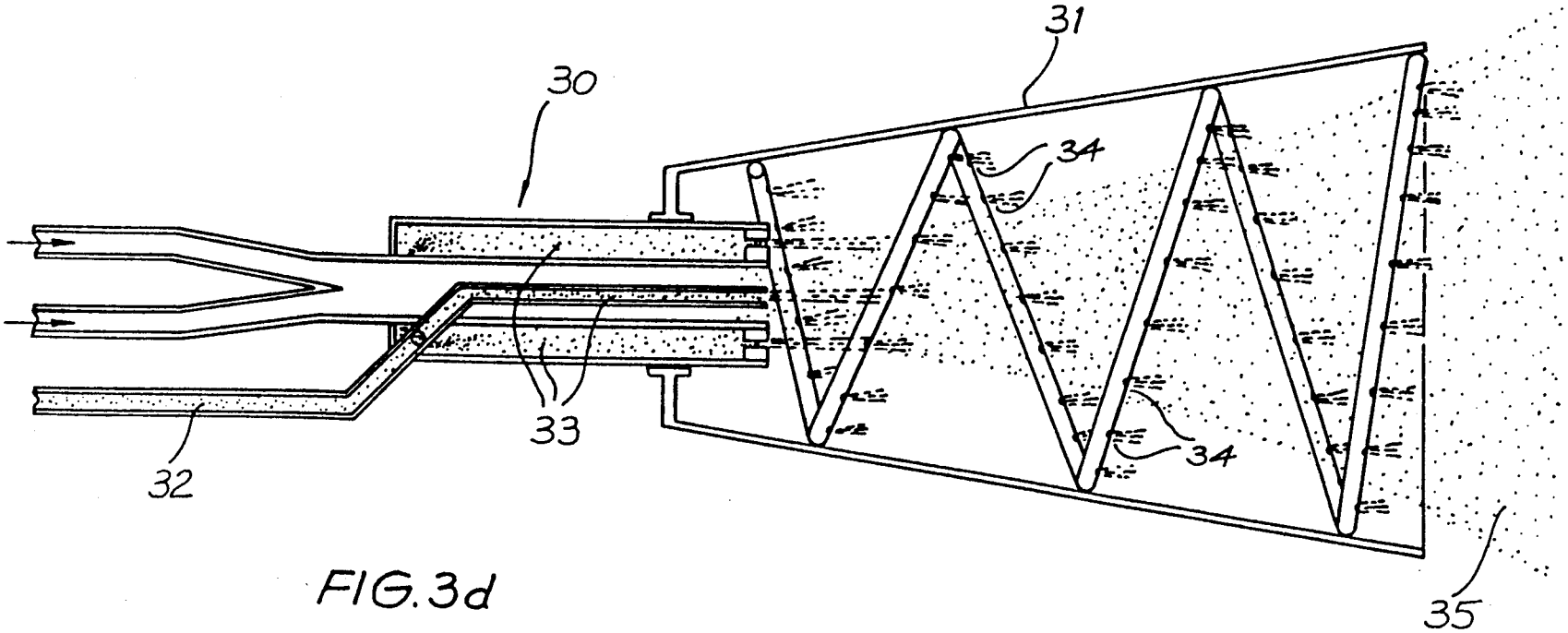

In FIG. 2 is shown a preferred embodiment of the snow-making apparatus, illustrating the portability of the invention. That is, the snow-making apparatus, comprising the fan 6, the chiller 7 and the dehumidifier 8, together with a storage facility 13 for the tent or dome-like structure 2 are provided on a ski-like arrangement 14. The tent or dome-like structure 2 may simply be withdrawn from the storage means 13 and dragged forwardly to cover the nozzle 9 of the machinery 5.

Therefore, the snow-making device and method of the present invention provides a closed environment system wherein the temperature, humidity and/or other environmental conditions are regulated as desired, to facilitate the production of snow, via a conventional snow gun. Due to the lightweight construction of the invention, the apparatus may be easily moved, such that upon completion of the snow-making operating at a particular place, the system may be easily moved to the next desired location. Obviously, in use, a large pile of snow may be produced at one point, and then a snow cat or the like may be utilised to spread the snow. The present invention therefore allows the production of snow in a controlled environment 24 hours a day, 365 days year anywhere in the world.

In a further preferred embodiment the present invention provides a snow making method and apparatus which obviates the need for specific refrigeration machinery. This is achieved by utilising gases in-any cold form, for instance nitrogen or carbon dioxide, which have characteristics of below zero temperatures in their normal gaseous state. This may be achieved by utilising gases which are cold in their normal state, or by providing the gases in compressed condition to induce a change of state and consequently provide low temperatures, such as, providing the gas in a compressed (liquid) condition, and allowing the mixture to change state to a gas. By supplying such gases within the tent or dome like structure 2, or within an insulating wall layer between the closed environment system 3 and the external environment 4, the snow gun supplied therein will then be provided at a low temperature environment suitable for snow production, without the necessity for the chiller 7. The tent or dome like structure 2 consequently forms a cold room, in which the snow may be produced, without the need for a mechanical chilling means. To provide such cold gases within the tent or dome like structure 2, the gases may be produced from a normal pressure cylinder, or may be machinery made.

Other advantages are also provided by the dome-like structure of the present invention. In particular, the tent or dome like structure 2 will stop wind from blowing the snow away whilst it is being made, and it will also protect the snow from sun, rain and other natural environmental effects. Optionally, a floor could be provided, either in solid form or in the form of a soft zip-on construction, such being particularly useful in the case where it is desirable to completely isolate the closed environment from the external environment. The tent or dome-like structure can also be optionally provided such that it is provided with a hole therein, such that the snow-making device is provided externally therethrough and directed through the wall of the tent or dome-like structure. Another advantage also provided by the present invention is that advertising material may be provided on the external face of the tent or dome like structure. Preferably, means is provided on the tent-like structure to recycle the gas, such as Nitrogen, such that same can be re-utilised. The dome-like structure also preferably is provided with a humidity exit means to exit any humidity in the closed environment.

In FIG. 3 is illustrated three alternative embodiments of nozzle arrangements which may be utilised in conjunction with an alternative embodiment of the present invention. Rather than providing a tent, dome-like or silo-like structure, as previously described, it may be preferable to provide an arrangement wherein the nozzle of a snow gun is adapted to provide the conditions suitable to induce the production of snow, as the products are emitted from the nozzle. In FIG. 3*a*, is shown a nozzle wherein cold liquid nitrogen or gaseous nitrogen is supplied by the inlet 15 of the nozzle 16. Air 17 and water 18 is supplied at the rear of the nozzle 16, and, due to the nozzle being effectively mixed with or chilled by the nitrogen or other similar gas means provided by inlet 15, the nozzle 16 is effectively chilled such that snow 17 is emitted therefrom. In the arrangement illustrated in FIG. 3*b*, the nozzle is provided with an annular arrangement therearound to which the inlet providing the cold nitrogen gas 15 is provided. The annular arrangement 20 can for instance be provided with a plurality of orifices around the inside annular surface thereof, to emit nitrogen towards the nozzle output, effectively controlling the temperature at the output such that snow 19 is produced thereby. A third possible arrangement illustrated in FIG. 3*c* shows a horn-like structure 21 adapted to be fitted to the end of a nozzle 16. In this embodiment, the nitrogen gas, or like gas, is supplied by the inlet 15 into the horn-like arrangement 21, such that a mini controlled environment is provided around the extremity of the nozzle, such that snow 19 may be emitted from the output of the horn. It will be understood to persons skilled in the art that suitable gases or liquids which may be supplied by the inlet 15 to or near the extremity of the nozzle 16 are gases such as nitrogen, carbon dioxide, and other gases with low temperature thermal characteristics in their normal state.

In FIG. 3(*d*) illustrates a more detailed example of the horn of FIG. 3(*c*), showing the entry of the air and water into the nozzle and the provision of the liquid nitrogen around the periphery of the horn. In FIG. 3(*d*) the nozzle, generally designated by the numeral 30 is connected to the horn 31. Liquid nitrogen, or other suitable gas 32 may be applied within the nozzle, generally designated by numeral 33, in the horn, at the plurality of outlets 34, or both. The liquid nitrogen may either be designed to cool the horn and/or nozzle but not mix with the snow 35, or alternatively, the liquid nitrogen 34 may mix with the snow 35, and be readmitted to the environment.

Figure 4:
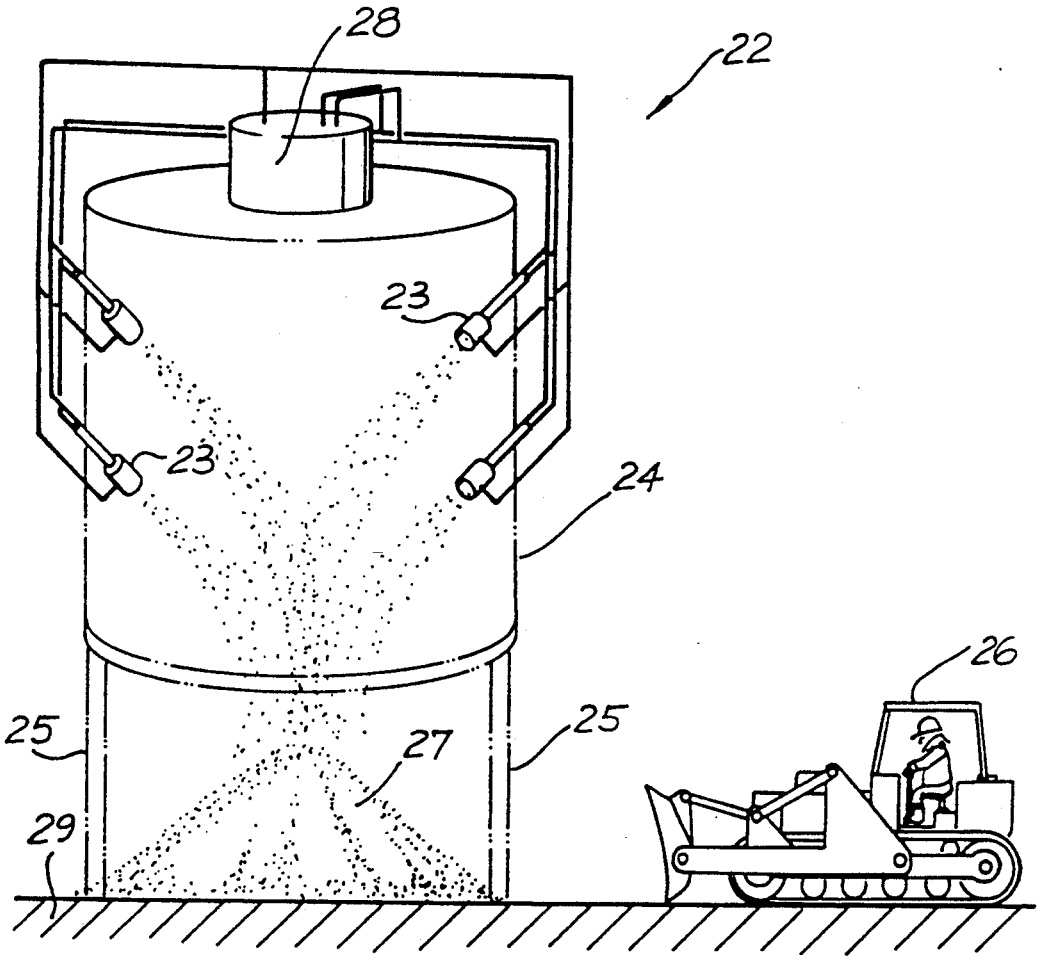

In FIG. 4 is illustrated a silo-like arrangement in accordance with the present invention. The silo-like arrangement, generally designated by the numeral 22 s built with a plurality of snow guns 23 provided within the silo body 24, the silo body 24 being provided on stuncheons 25 at an elevation such that a snow cat 26 or like device may be driven under the silo body 24, such that the snow 27 which accumulates under the silo may be spread over the ground surface as required. The silo-like arrangement preferably is provided with the necessary refrigerant machinery 28 on the top thereof or, alternatively underground, such that the ground surface 29 is not cluttered with unnecessary articles and machinery.

In a further preferred embodiment of the present invention, machinery of a type well known in the art is provided to extract nitrogen from the surrounding air, and compress same. This means that the nitrogen, or other appropriate gas, can be manufactured on site, rather than having to transport same to the location of the snow making machinery. This would also mean that after utilisation of the gas at the desired location, the gas can be released into the atmosphere, if desired, after use thereof.

Obviously, in the implementation of the tent-like, dome-like or silo-like arrangements, materials are preferably chosen such that they have good thermal insulative properties, such that the energy required to provide the controlled environment is minimised. Obviously the amount of thermal insulation will vary depending on the particular location, and the desired temperature difference which is required in comparison to the surrounding environment.

It will be understood that numerous other modifications are envisaged to the present invention. For instance, if desired, a conveyor belt arrangement may be provided to move the snow from the location of production to the desired ground surface. The present invention may be preferably embodied such that the snow making device is portable, for instance mounted on a snow cat, however, obviously, with embodiments such as the silo-like arrangement, it is more likely to be implemented as a fixed structure. Also, optionally, an air flow direction system can be incorporated into the controlled environment. This would preferably take the format of having a plurality of baffles.

It will be understood by a person skilled in the art that numerous other variations or modifications are envisaged to the present invention. For example, instead of supplying the machinery 5, totally separated to the snow gun 10, an integrated system may be envisaged, wherein the air and water hoses 11 or the contents therein may be chilled or dehumidified. In such an embodiment, it would then only be necessary to supply the snow gun 10 within the tent or dome-like structure 2, further increasing the portability of the invention. Such an integrated system wherein the chilling and dehumidifying machinery 5 is incorporated with the snow gun 1.0..,--would be particularly suitable in Australian conditions, wherein the is a high probability that the chillers and dehumidifiers are required most of the time. In such conditions the chillers and dehumidifiers can be supplied underground at a central location at the point where the air and water hoses originate. Obviously, the tent or dome-like structure 2 may be portable or a permanent construction, and is may incorporate a frame or have a frameless structure. An air supported frame is also envisaged, wherein an insulating air pocket is supplied between the closed environment and the external environment, for the dual purpose of insulating the two environments and also separating the structure 2.

The present invention may therefore be utilised in a situation to supplement the natural snow falls in an environment, or provide snow in an environment where snow falls are not normally naturally occuring.

These and other variations should be considered to fall within the scope of the invention as hereinbefore described and as hereinafter claimed.

I claim:

1. A device for the production of snow adjacent the downstream end of the device, comprising:

(A) a first outlet to supply water therethrough under pressure; and (B) a second outlet to supply cryogenic gas therethrough provided substantially adjacent to or downstream in said device from said first outlet;

whereby, as water is emitted from said first outlet and subsequently passes through the cryogenic gas, the temperature of the water is lowered to form snow adjacent the downstream end of said device;

said device being characterized by causing the formation of the snow in the absence of propeller means.

2. The device of claim 1, including means for providing to said second outlet the cryogenic gas, the cryogenic gas being selected from the group consisting of $N_z$, $CO_2$ compressed air, and any other gas having low thermal characteristics under normal or compressed conditions.

3. The device of claim 2, wherein said providing means provides the cryogenic gas under pressure.

4. The device of claim 1, including a horn-like apparatus surrounding the first and second outlets and wherein the cryogenic gas creates an artificial environment within said horn-like apparatus.

5. The device of claim 1, wherein said device is disposed on transportation means.

6. The device of claim 2, wherein said providing means comprises extraction means to extract gases from a surrounding environment and compress the same, such that said extracted and compressed gases can be utilized as the cryogenic gas.

7. A device for the production of snow adjacent the downstream end of the device, comprising:

(A) a first outlet to supply water therethrough under pressure; and (B) a second outlet to supply cryogenic gas therethrough said second outlet being provided substantially adjacent to or downstream in said device from said first outlet;

whereby, as water is emitted from said first outlet and subsequently passes through the cryogenic gas, the temperature of the passing water is lowered to form snow adjacent the downstream end of said device;

said device being characterized by causing the formation of the snow in the absence of propeller means.

8. A device for the production of snow adjacent the downstream end of the device, comprising:

(A) a first outlet to supply water therethrough under pressure;

(B) a second outlet to supply cryogenic gas;

(C) a third outlet to supply a gaseous substance therethrough under pressure;

wherein, each of said first and third outlets are provided substantially adjacent to or upstream from said second outlet such that the products emitted from said first, second and third outlets substantially mix downstream from said first and third outlets in said device, whereat the temperature of the water is lowered such that snow is formed adjacent the downstream end of said device.

9. A method for the production of snow adjacent the downstream end of a device, comprising the steps of:

(A) supplying water under pressure to an inlet of a nozzle of the device;

(B) maintaining an artificial by supplying environment cryogenic gas adjacent to a downstream in the device form an outlet of the nozzle; and (C) causing the water to travel through the artificial environment;

whereby, as the water travels through the artificial environment, the water is lowered in temperature such that snow is emitted from the artificial environment adjacent the downstream end of the device;

no propeller means being required to cause the formation of the snow.

10. The method of claim 9, wherein, to maintain the artificial environment, cryogenic gas is provided at or about the nozzle outlet.

* * * * *